US005997218A

United States Patent [19]

Børseth

[11] Patent Number: 5,997,218

[45] Date of Patent: Dec. 7, 1999

[54] METHOD OF AND APPARATUS FOR STABILIZING A TENSION-LEG PLATFORM IN DEEP WATER OPERATIONS

[75] Inventor: Knut Børseth, TÅrnÅsen, Norway

[73] Assignee: Petroleum Geo-Services AS, Lysaker, Norway

[21] Appl. No.: 08/944,004

[22] Filed: Oct. 1, 1997

Related U.S. Application Data

[63] Continuation of application No. 08/602,665, Feb. 16, 1996, abandoned.

[51] Int. Cl.[6] ..... B63B 35/44; B63B 39/00

[52] U.S. Cl. ..... 405/223.1; 405/224

[58] Field of Search ..... 405/223.1, 224, 405/224.1, 226

[56] References Cited

U.S. PATENT DOCUMENTS

| | | | |
|---|---|---|---|
| 3,408,821 | 11/1968 | Redshaw | 405/200 |
| 4,062,313 | 12/1977 | Stram | 405/223.1 X |
| 4,372,240 | 2/1983 | Michael | 114/56 |
| 4,432,671 | 2/1984 | Westra et al. | 405/226 |
| 4,869,192 | 9/1989 | Pawolski | 114/265 |
| 4,936,710 | 6/1990 | Petty et al. | 405/224 |
| 5,421,676 | 6/1995 | Wybro et al. | 405/223.1 |

FOREIGN PATENT DOCUMENTS 147 336 B 12/1982 Norway .

OTHER PUBLICATIONS

"Monopod TLP Improves Deepwater Economics," Petroleum Engineer, Jan. 1993.

E.C. Clusky, et al., "The Response of Suction Caissons in Normally Consolidated Clays to Cyclic TLP Loading Conditions," Proceedings of 27$^{th}$ Annual Offshore Technology Conference, May, 1995, vol. 2, pp. 909–918.

J.L. Colliat, et al., "Caisson Foundations as Alternative Anchors for Permanent Mooring of a Process Barge Offshore Congo," Proceedings of 27$^{th}$ Annual Offshore Technology Conference, May 1995, vol. 2, pp. 919–929.

*Primary Examiner*—David Bagnell
*Assistant Examiner*—Tara L. Mayo
*Attorney, Agent, or Firm*—Gordon T. Arnold; Arnold & Associates

[57] ABSTRACT

A process comprising: generating a stabilizing moment, before the platform is secured and tensioned to the sea floor, wherein the generating vertically aligns the central axis of the TLP; and reducing the size of the TLP in the wave zone, after a tendon of the platform is secured to the sea floor. A device comprising: a generator of a stabilizing moment, before the platform is secured and tensioned to the sea floor, wherein the generator vertically aligns the central axis of the TLP; and a reducer of the size of the TLP in the wave zone, after a tendon of the platform is secured to the sea floor. A tension-leg platform (TLP) comprising: a buoyancy structure for floating the TLP at the sea surface; a platform for mineral production operations located above the sea surface; a support which connects at a lower end to the buoyancy structure and connects at an upper end to the platform; a tendon which fixes the TLP to the sea floor; a generator of a stabilizing moment, before the tendon is fixed to the sea floor, wherein the generator vertically aligns the central axis of the TLP; and a reducer of the size of the TLP in the wave zone. A process comprising: stabilizing the buoyancy-support with the float; ballasting the buoyancy-support until the buoyancy-support resides lower in the sea relative to the sea surface; and assembling the platform to the buoyancy-support.

35 Claims, 16 Drawing Sheets

FIG. 1A1
PRIOR ART

FIG. 1A2
PRIOR ART

METHOD OF AND APPARATUS FOR STABILIZING A TENSION-LEG PLATFORM IN DEEP WATER OPERATIONS

CROSS REFERENCE TO RELATED APPLICATION

This application is a continuation of copending application Ser. No. 08/602,665, filed Feb. 16, 1996, which application is now abandoned.

FIELD OF THE INVENTION

This invention relates to deep water, mineral production, tension-leg platform vessels.

BACKGROUND OF THE INVENTION

Assembly of tension leg platforms ("TLP's") is a traditional problem in offshore exploration and production areas, one cause of which is the resonance action of waves on the float columns. As shown in FIGS. 1*a*1 and 1*a*2, a standing wave may act upon the TLP to generate resonant heave (vertical) motion in the TLP. When the trough of the wave passes the TLP, the sea provides a smaller buoyancy force because less water is displaced by the column. When the crest of the wave passes the TLP, a larger buoyancy force is provided because more water is displaced. The heave motion is detrimental to TLPs because they are secured to the sea floor by tendons and heave resonance causes the tendons to fail. Also, the action of the waves against the side of the column generate vibrations in the TLP system which, if they occur at a harmonic frequency of the TLP system, may cause the tendons to fail. Thus, TLP need to have effectively transparent cross-sections in the wave zone after being secured to the sea floor.

Thus, prior TLP configurations comprise a relatively transparent structures in the wave zone to reduce the effects of wave loading. The traditional TLP configuration comprises a horizontal submerged float that is connected to the platform by vertical supports. Monopods, such at that disclosed in *Monopod TLP Improves Deepwater Economics*, PETROLEUM ENGINEER INTERNATIONAL (January 1993), incorporated herein by reference, comprise a central monopod support attached to a plurality of submerged floats, such as corner columns. Other platform structures have been proposed which comprise a monopod, but instead of corner columns, they comprise a single column, as shown in FIGS. 1*a*1 and 1*a*2, from which the monopod extends. Hove while prior TLPs provide relatively transparent structures in the wave zone, they are unstable prior to attachment to the sea floor. These TLPs typically require assembly of the main production platform after being transported to the operation site. The TLP instability makes the platform assembly a difficult and costly procedure requiring a large derrick barge to stabilize the TLP. Disassembly is likewise difficult so that the TLPs are practically immobile so that they cannot be transported from one production site to another without reducing the TLP's topside weight.

Therefore, there is a need for a TLP which provides greater stability during assembly and transportation, without sacrificing a transparent wave zone structure which is required after the TLP is secured to the sea floor.

SUMMARY OF THE INVENTION

An object of the present invention is to address the assembly and resonance problems, in one embodiment, by a device that provides stability to the TLP while the TLP is transported and assembled. Further, the invention allows the TLP to be configured to provide a transparent structure in the wave zone after being secured to the sea floor.

According to one aspect of the invention, there is a process comprising: generating a stabilizing moment (securing sufficient stability), before the platform is secured and tensioned to the sea floor, wherein the generating vertically aligns the central axis of the TLP; and reducing the size of the TLP in the wave zone, after a tendon of the platform is secured to the sea floor.

According to another aspect of the invention, there is a device comprising: a generator of a stabilizing moment, before the platform is secured and tensioned to the sea floor, wherein the generator vertically aligns the central axis of the TLP; and a reducer of the size of the TLP in the wave zone, after a tendon of the platform is secured to the sea floor.

According to a further aspect of the invention, there is a tension-leg platform (TLP) comprising: a buoyancy structure for floating the TLP at the sea surface; a platform for mineral production operations located above the sea surface; a support which connects at a lower end to the buoyancy structure and connects at an upper end to the platform; a tendon for affixing the TLP to the sea floor; a generator of a stabilizing moment, before the tendon is affixed to the sea floor, wherein the generator vertically aligns the central axis of the TLP; and a reducer of the size of the TLP in the wave zone.

According to a still further aspect of the invention, there is a process comprising: stabilizing the buoyancy-support with the float; ballasting the buoyancy-support until the buoyancy-support resides lower in the sea relative to the sea surface; and assembling the platform to the buoyancy-support.

BRIEF DESCRIPTION OF THE DRAWING

The present invention is better understood by reading the following description of nonlimitative embodiments with reference to the attached drawings, wherein like parts in each of the several figures are identified by the same reference character, which are briefly described as follows:

FIG. 1*a*1 and 1*a*2 are plain views of a prior art monopod TLP.

FIG. 2 is a flow chart describing the steps for assembling the tension-leg platform.

FIG. 11*a*1 and 11*a*2 are views of an embodiment of an attacher of the generator to the TLP.

FIG. 11*b*1 and 11*b*2 are views of an embodiment of an attacher of the generator to the TLP and a top view of the generator alone.

It is to be noted, however, that the appended drawings illustrate only typical embodiments of the invention and are therefore not to be considered a limitation of the scope of the invention which includes other equally effective embodiments.

DETAILED DESCRIPTION OF THE INVENTION

Figure 1:
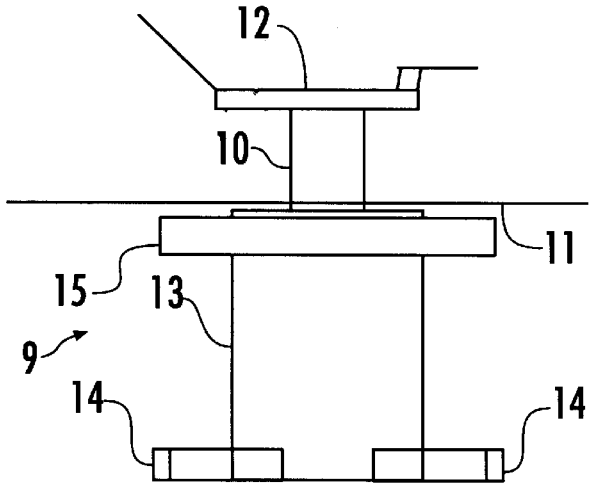
FIG. 1 is a plan view of one embodiment of the inventive tension-leg platform.
Figure 1:
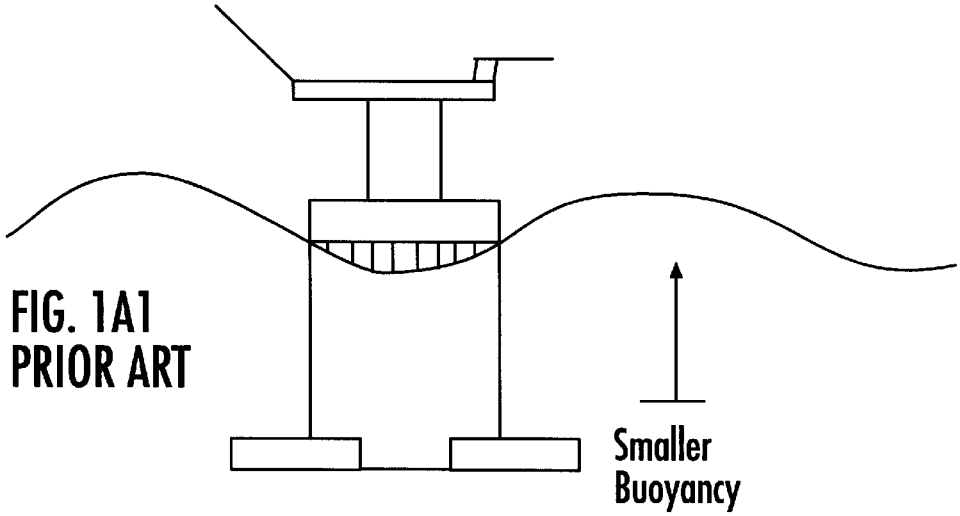
Figure 1:
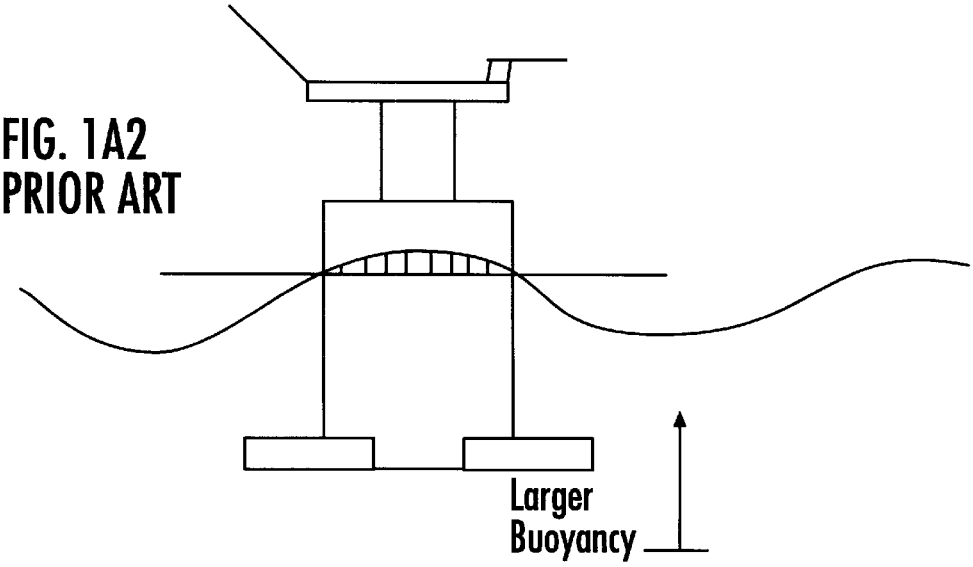

Referring to FIG. 1, one embodiment of a tension-leg platform according to the present invention is shown. The tension-leg platform (TLP) comprises a monopod configuration. The portion of the TLP 9 which extends above the water surface 11 comprises the monopod 10 and the platform 12. The portion of the TLP 9 that extends below the water surface 11 comprises a main buoyancy structure 13, pontoons 14, and a float 15. The main buoyancy structure 13 is cylindrical in shape with its longitudinal axis oriented in a vertical position when the tension-leg platform 9 is arranged in an operational configuration. The pontoons 14 are attached to the bottom of the main buoyancy structure 13 and extend horizontally outward from the central axis of the main buoyancy structure 13. The float 15 is configured so that it encircles the main buoyancy structure 13. Further, float 15 may be moved from a position near the top of the main buoyancy structure 13 to a position at the bottom of main buoyancy structure 13 near pontoons 14. The float 15 comprises a generator of a stabilizing moment because it serves to return the vertical central axis of the TLP to a vertical position upon deflection by wave, wind, etc. which act on the TLP.

Figure 1B:
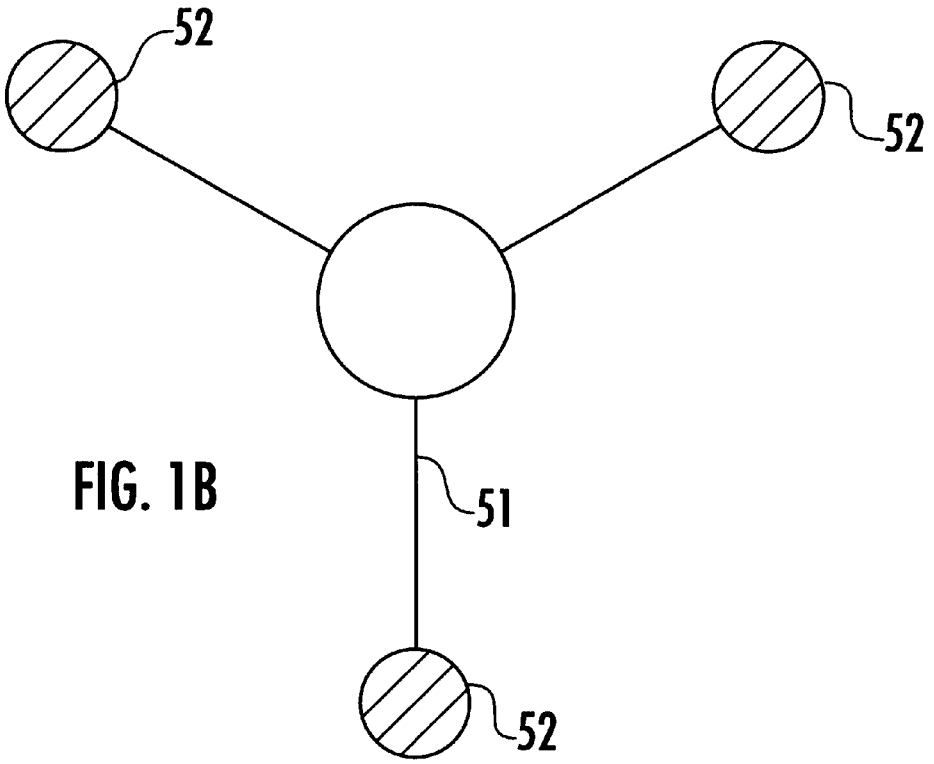
FIG. 1*b* is a top view of an embodiment of a generator of a stabilizing moment.
Figure 1C:
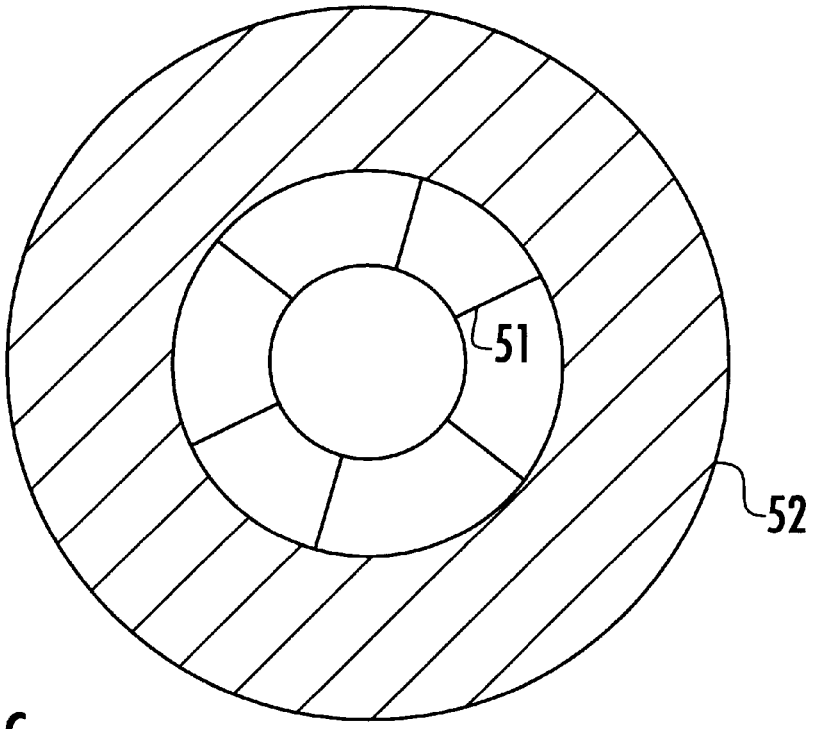
FIG. 1*c* is a top view of an embodiment of a generator of a stabilizing moment.

As shown in FIG. 1*b*, the generator of a stabilizing moment may comprise a structure with at least three extensions 51 which extend radially out from the central axis of the TLP. Displacers of seawater 52 are attached at the ends of the extensions 51. Also, as shown in FIG. 1*c*, the displacers of seawater 52 may be merged to a single structure. This structure may assume any geometric shape so long as it displaces uniform volumes of seawater symmetrically.

Referring to FIGS. 2 and 3*a*–3*g*, a flow chart is shown for the construction of a tension leg platform and drawings depicting each step of the process, respectively. First, the main buoyancy structure 13 is constructed 201 with the monopod 10 attached. Also, portions of the pontoons 14 are also attached to the main buoyancy structure 13. Further, the float 15 is constructed 201 separately. The main buoyancy structure 13 and float 15 are then launched 202 into the water. At this point, the float 15 lays flat upon the surface of the water while main buoyancy structure 13 is oriented horizontally. The remaining sections of pontoons 14 are attached 202 to the sections which had originally been attached to main buoyancy structure 13. The pontoons are attached in two sections at a time because of the difficulty in transporting main buoyancy structure 13 across a surface when pontoons 14 are too lengthy. Thus, main buoyancy structure 13 is rolled in the water to expose each pontoon in sequence so that an additional section may be added to each. Next, the float 15 is ballasted 203 so that its central axis is oriented in a horizontal direction. The main buoyancy structure 13 is also ballasted 203 so that its central axis is also in a horizontal direction. With the pieces of the tension leg platform in the horizontal orientation, the pieces can be easily assembled. Float 15 is slipped 204 over the monopod 10 and onto the main buoyancy structure 13. It is then attached to the main buoyancy structure 13 at the end closest to the monopod 10. Next, the tension-leg platform is ballasted 205 so that it is oriented with the longitudinal axis of the main buoyancy structure 13 in a vertical direction. The float 15 also has its central axis in a vertical direction and resides just below the surface of the water 11. Thus, the main buoyancy structure 13 and the pontoons 14 extend below the surface of the water while the monopod 10 extends above the surface of the water 11. Note that in this orientation, the tension-leg platform may be transported 206 to the site for operation, although it may also be towed disassembled and assembled on site. Upon reaching the site, the tension-leg platform is ballasted 207 so that the entire tension-leg platform sinks deeper into the water so as to expose only a portion of the monopod 10. A barge 16 is used to transport a platform 12 to the operation site. The barge 16 has a notch 17 which is large enough to encircle the monopod 10. Thus, with the tension-leg platform in a lowered position, the barge 16 may position the platform 12 above the monopod 10. The platform 12 is then assembled 208 to the monopod 10. Finally, the assembled TLP is deballasted 209. The tension-leg platform is now fully assembled and may now be attached to the ocean floor for operation.

Figure 4:
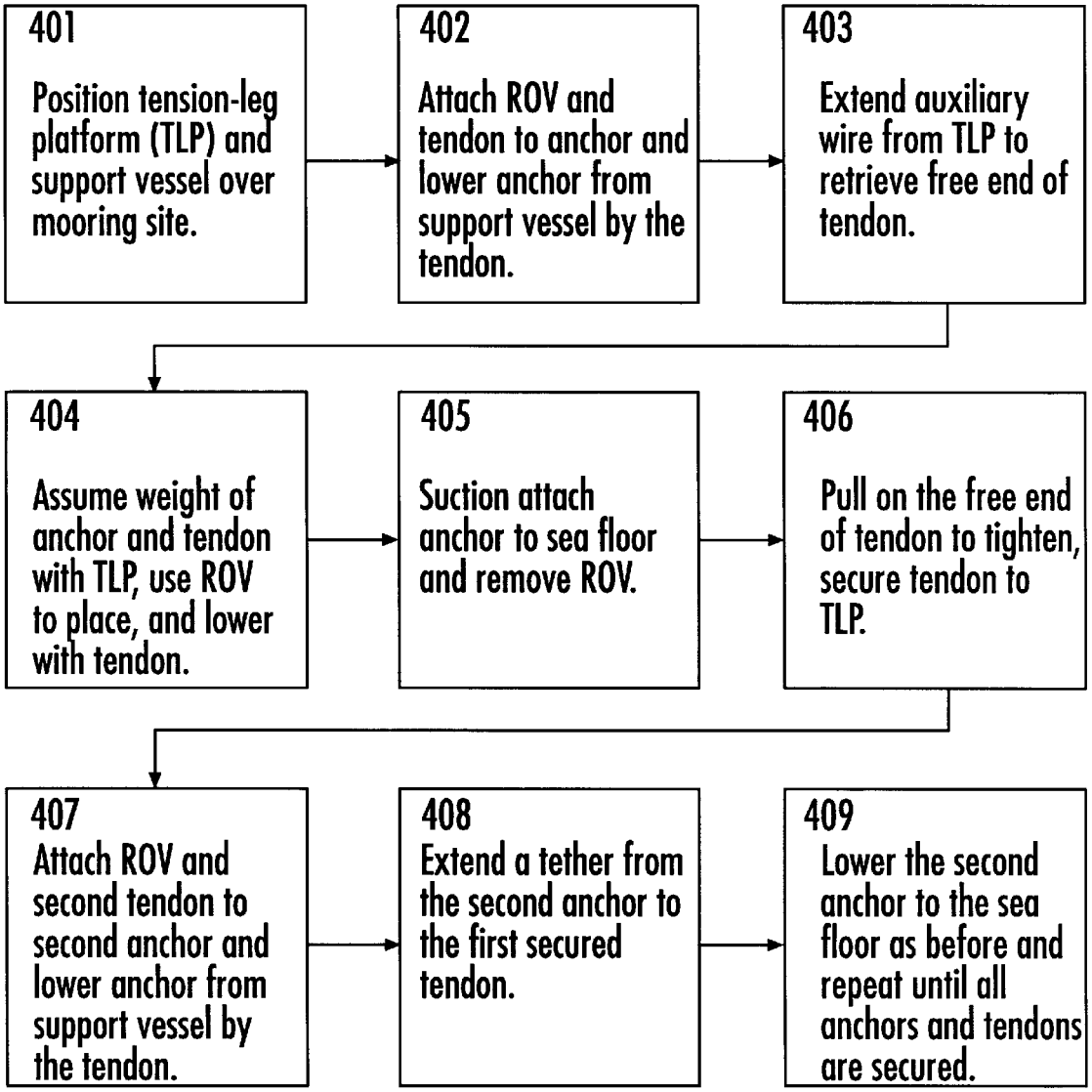
FIG. 4 is a flow chart describing the steps for attaching the tension-leg platform to the sea floor.
Figure 5A:
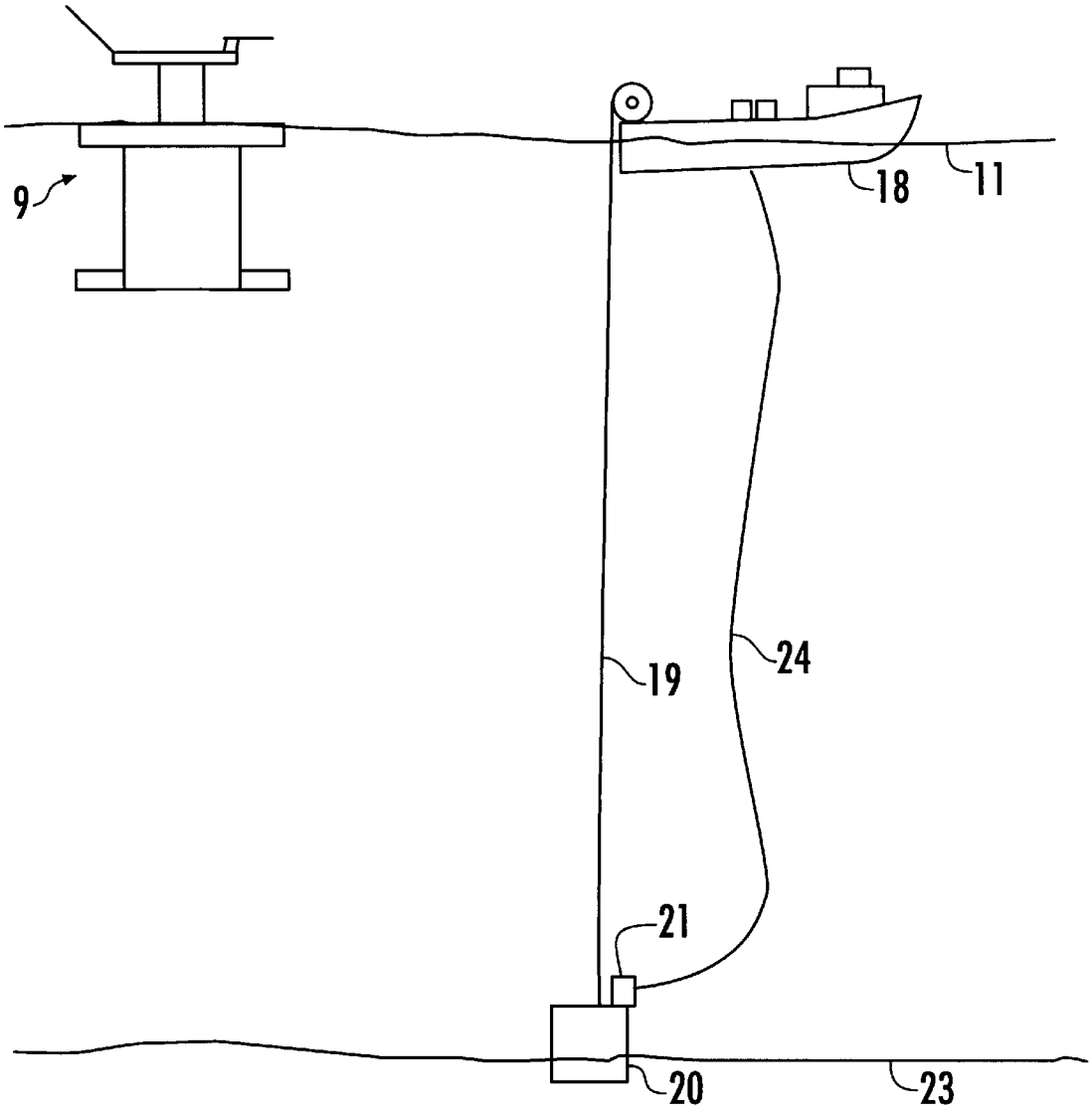
FIG. 5*a* is a plan view of the attachment apparatuses for attaching a tendon of the tension-leg platform to the sea floor in an initial mode of operation.
Figure 5B:
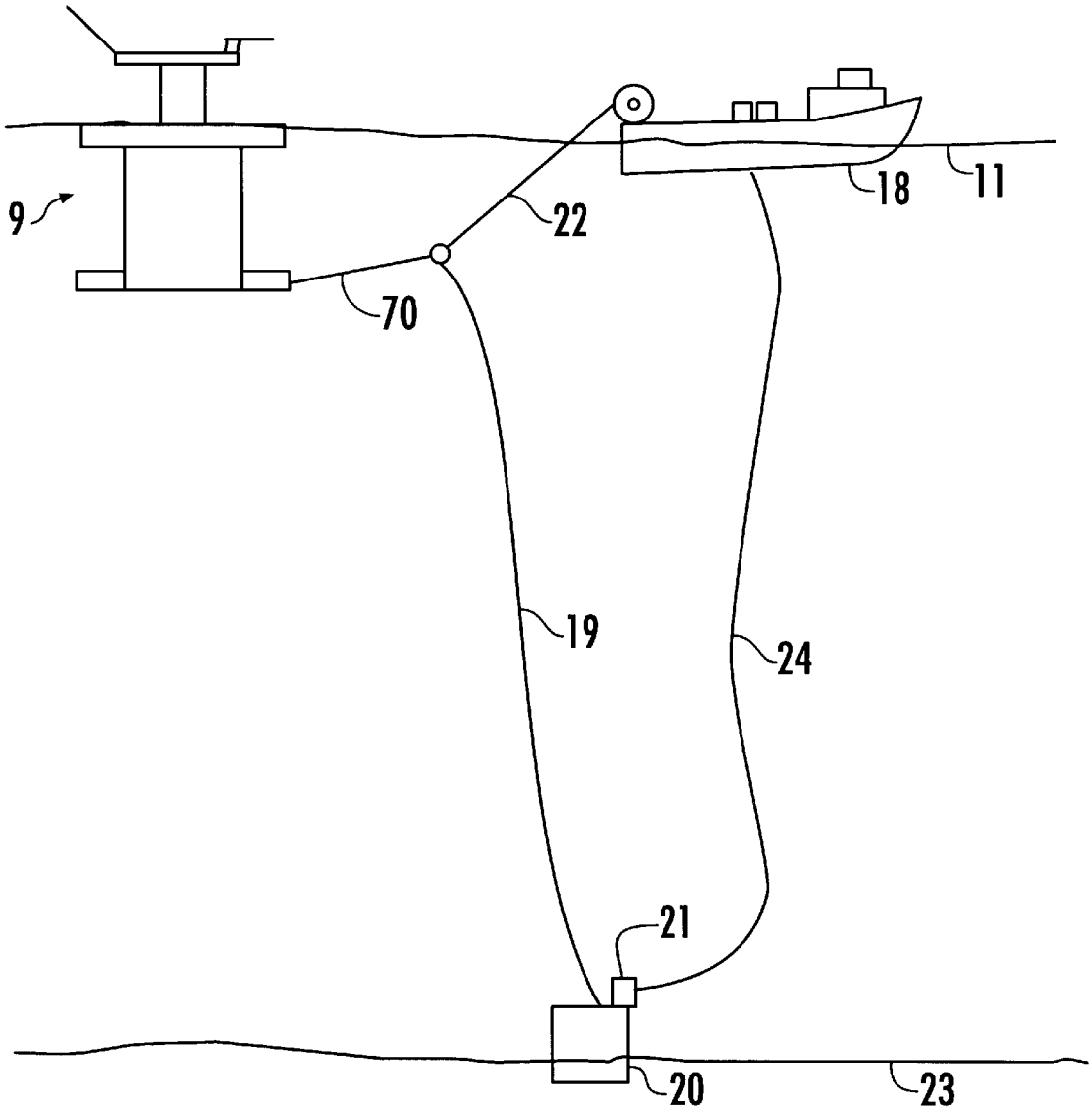
FIG. 5*b* is a plan view of the attachment apparatuses for attaching the tendon to the sea floor in a subsequent mode of operation.
Figure 5C:
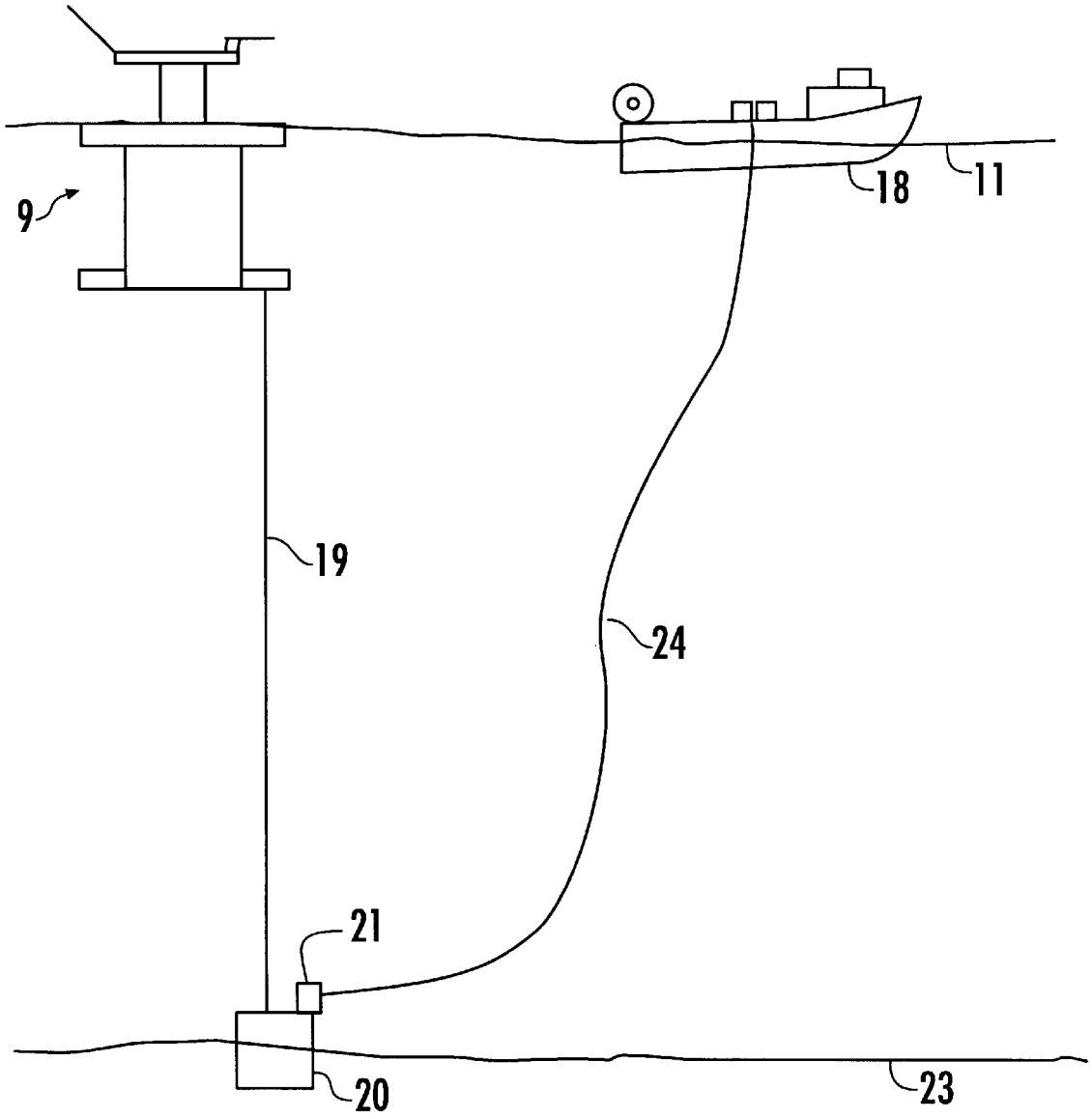
FIG. 5*c* is a plan view of the attachment apparatuses for attaching the tendon to the sea floor after the tendon is secured.
Figure 6:
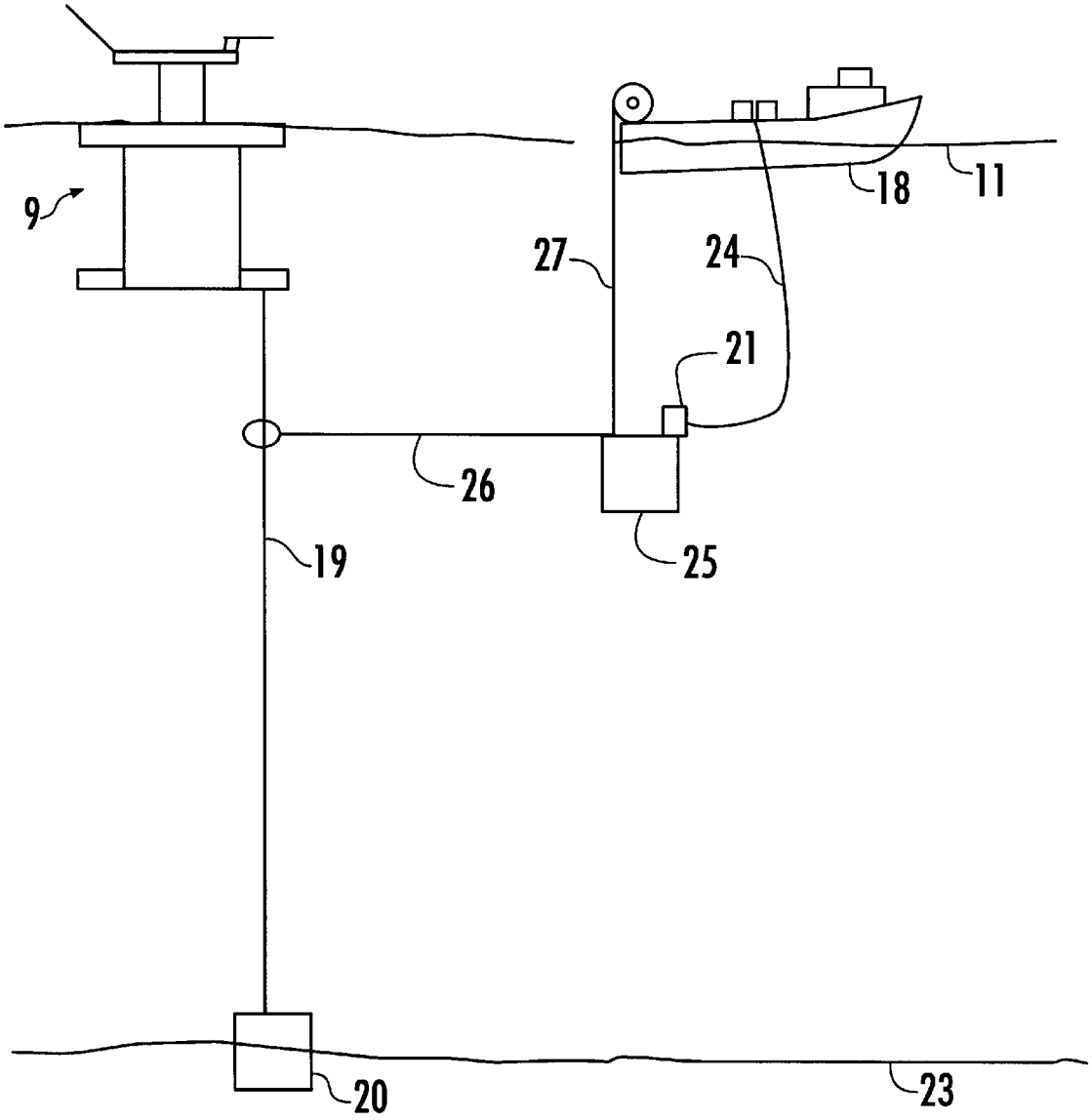
FIG. 6 is a plan view of the attachment apparatuses for attaching a second tendon to the sea floor.

Referring to FIGS. 4. 5*a*, 5*b*, 5*c* and 6, steps for the process of attaching the tension leg platform to the sea floor and drawings disclosing the process are shown. First, a tension leg platform 9 and a support vessel 18 are both positioned 401 over the mooring site. A tendon 19 and a remotely operated vehicle (ROV) are attached 402 to an anchor 20. The anchor 20 is lowered from the support vessel 18 by the tendon 19. As the suction anchor and ROV are lowered towards the sea floor 23, the tendon 19 is unspooled from the support vessel 18. An umbilical cord 24 for the ROV and suction anchor is attached to the ROV and is also unspooled as the suction anchor is lowered. After the anchor 20 is placed on the sea floor 23, an auxiliary wire 70 is extended 403 from the TLP 9 to retrieve the free end of the tendon 19 as it is released from the support vessel 18. Alternatively, the free end of the tendon 19 may be transferred before the anchor 20 reaches the sea floor 23 by the auxiliary wire 70 and a hook wire 22. The weight of the anchor and tendon would then be supported by the auxiliary wire 70 and hook wire 22 during the transfer.

The weight of the tendon 19 and suction anchor 20 is then assumed 404 by the TLP and the ROV is used 404 to place the anchor 20 in the desired location. This is done because the tension leg platform 19 is much more stable than the support vessel 18 so as to provide more stability when placing the suction anchor 20 upon the sea floor 23. The ROV 21 is operated 404 to place the suction anchor 20 in the desired location while the tendon 19 lowers the suction anchor 20 to the sea floor 23. The suction anchor 20 is then attached 405 to the sea floor 23 and the ROV is removed 405. This procedure is more fully described below. A winch or there pulling device is then used to pull 406 on the free end of the tendon 19 until the desired tension is obtained. Finally, the tendon 19 is secured 406 to the TLP. This attachment step 406 is more fully described below.

Upon deposit of the suction anchor 20 on the sea floor, the ROV 20 and auxiliary wire 70 are returned 405 to the support vessel 18 where they are again attached 407 to a second suction anchor 25. A second tendon 27 is also attached 407 to the anchor 25. Additionally, a tether 26 is attached 408 from the anchor 25 to the tendon 19 which is already secured to the sea floor 23. Again, the tendon 27 is used to lower 409 the anchor 25 to the sea floor 23. The free end of the tendon 27 is transferred to the TLP and the ROV 21 is used to pull the anchor 25 horizontally away from anchor 20 so that tether 26 is fully extended. Tendon 27 then lowers anchor 25 to the sea floor 23 where it is attached. The process is then repeated for subsequent anchors until all anchors are placed on the sea floor 23 in their proper positions.

Figure 7:
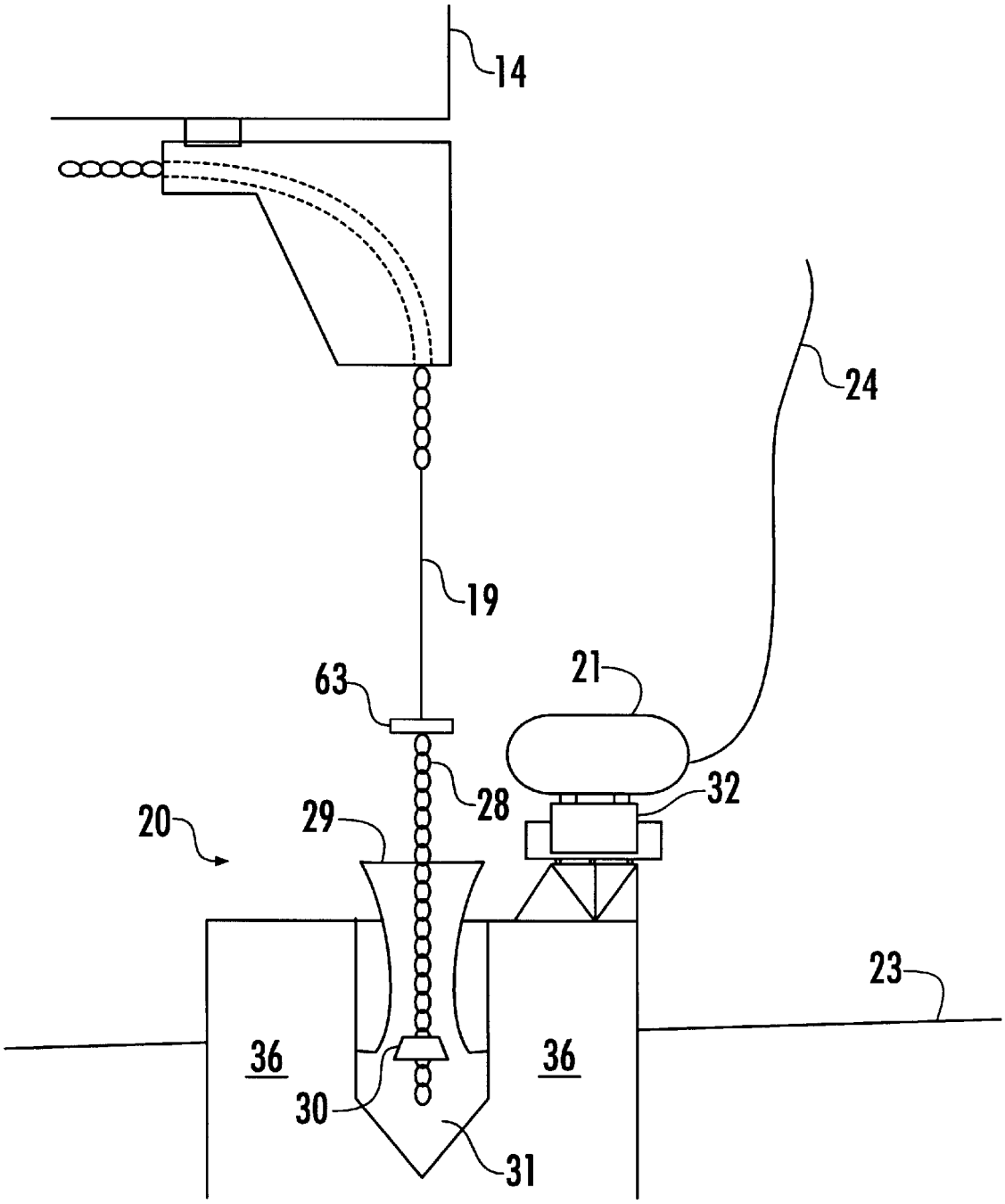
FIG. 7 is a plan view of the tendon and suction anchor.

Referring to FIG. 7, one embodiment of the suction anchor is shown. First of all, the tendon 19 is attached to one end of a chain 28. A spinner 63 is used to make the connection so that the tendon 19 may rotate relative to the chain 28. The other end of the chain 28 is inserted into a funnel 29 located near the top of the anchor 20. Inside the funnel 29, the chain 28 is engaged by a chain stopper 30 which locks it into place. Excess links of the chain 28 are stored in a chain locker 31 below the funnel 29.

In one embodiment, for a TLP weighing about 6000 tons, the chain 28 may comprise 4 inch, oil-rig-quality chain. The tendon may comprise spiral strand wire having a 110 mm diameter. Further, the suction anchor 20 may be made of single steel cylinders with a wall thickness of 20 mm. The total weight of the anchor may range from about 25 tons (3.5 m diameter and 7.5 m long) to about 40 tons (5 m diameter and 11 m long). See J-L. Colliat, P. Boisard, K. Andersen and K. Schroeder, *Caisson Foundations as Alternative Anchors for Permanent Mooring of a Process Barge Offshore Congo*, OFFSHORE TECHNOLOGY CONFERENCE PROCEEDING, Vol. 2, pgs. 919–929 (May 1995); E. C. Clukey, M. J. Morrison, J. Garnier and J. F. Cortè, *The Response of Suction Caissons in Normally Consolidated Clays to Cyclic TLP Loading Conditions*, OFFSHORE TECHNOLOGY CONFERENCE PROCEEDING, Vol. 2, pgs 909–918 (May 1995), both incorporated herein by reference.

Figure 8A:
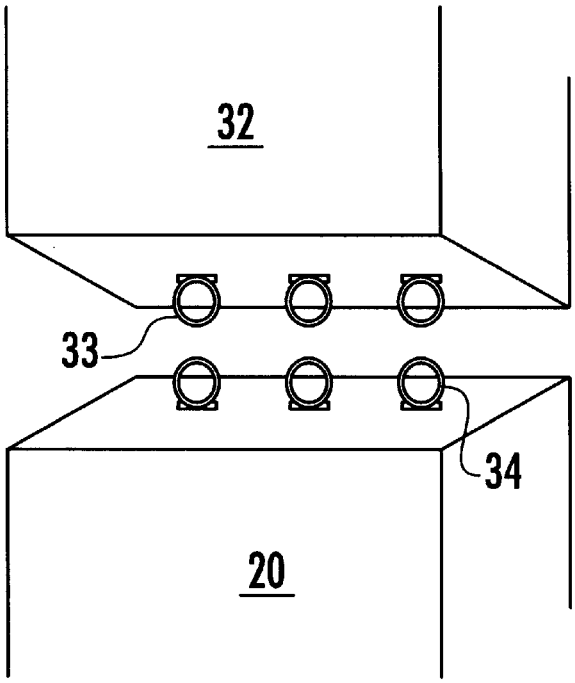
FIG. 8*a* is a plan view of the ROV-POD and anchor.
Figure 8B:
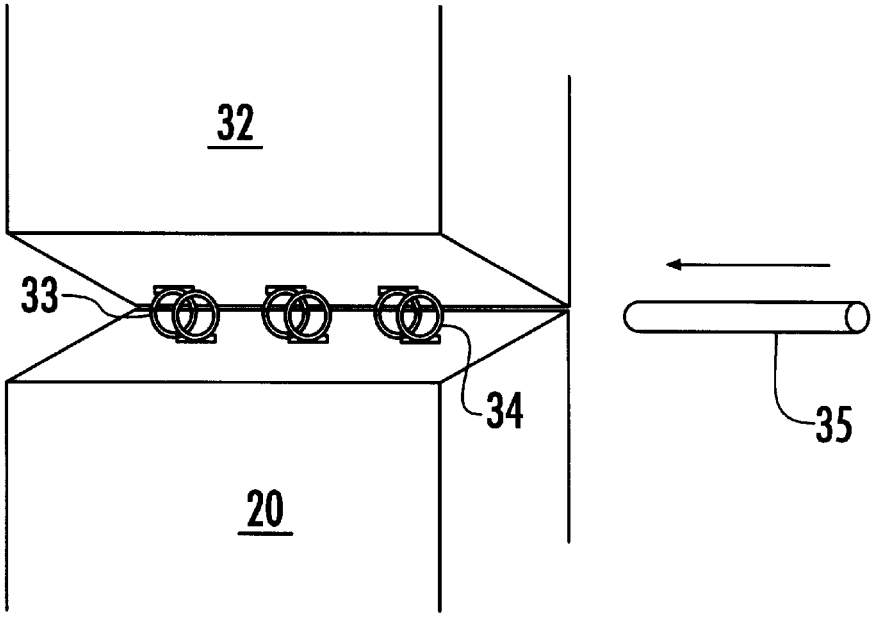
FIG. 8*b* is a plan view of the ROV-POD, anchor and attachment dowel.

The ROV 21 is attached to a ROV pod 32. The ROV pod 32 in turn engages the anchor 20. As shown in FIG. 8*a*, the ROV pod 32 comprises a series of rings 33. The anchor 20 also has a series of rings 34. The devices are connected by bringing the ROV pod 32 in close proximity with the anchor 20 so that rings 33 are placed adjacent to rings 34. As shown in FIG. 8*b*, with the rings juxtaposed, a dowel 35 may be inserted into the rings 33 and 34 to connect the ROV pod 32 to the anchor 20.

Referring again to FIG. 7, the anchor 20 also comprises a series of chambers 36. Each of these chambers are closed on all sides with the exception of the bottom side which is adjacent to the sea floor 23. The anchor is attached to the sea floor 23 by pumping air into the chambers 36 with air supplied by umbilicals 24. Water is pushed out from the chambers by the air through one-way valves between the chambers and the exterior of the anchor. Once the chambers are filled with air, the air is immediately evacuated to create low pressure inside the chambers. This creates a suction which causes the anchor to adhere to the sea floor 23. The air may be evacuated by pumps or by allowing the air in the anchor to be exposed to atmospheric pressure at the sea surface via a hose. When the anchor is to be released from the sea floor, air is pumped back into the chambers to increase the pressure. Multiple chambers 36 provide redundancy to prevent the entire anchor from becoming detached should one of the chambers fail.

Figure 9A:
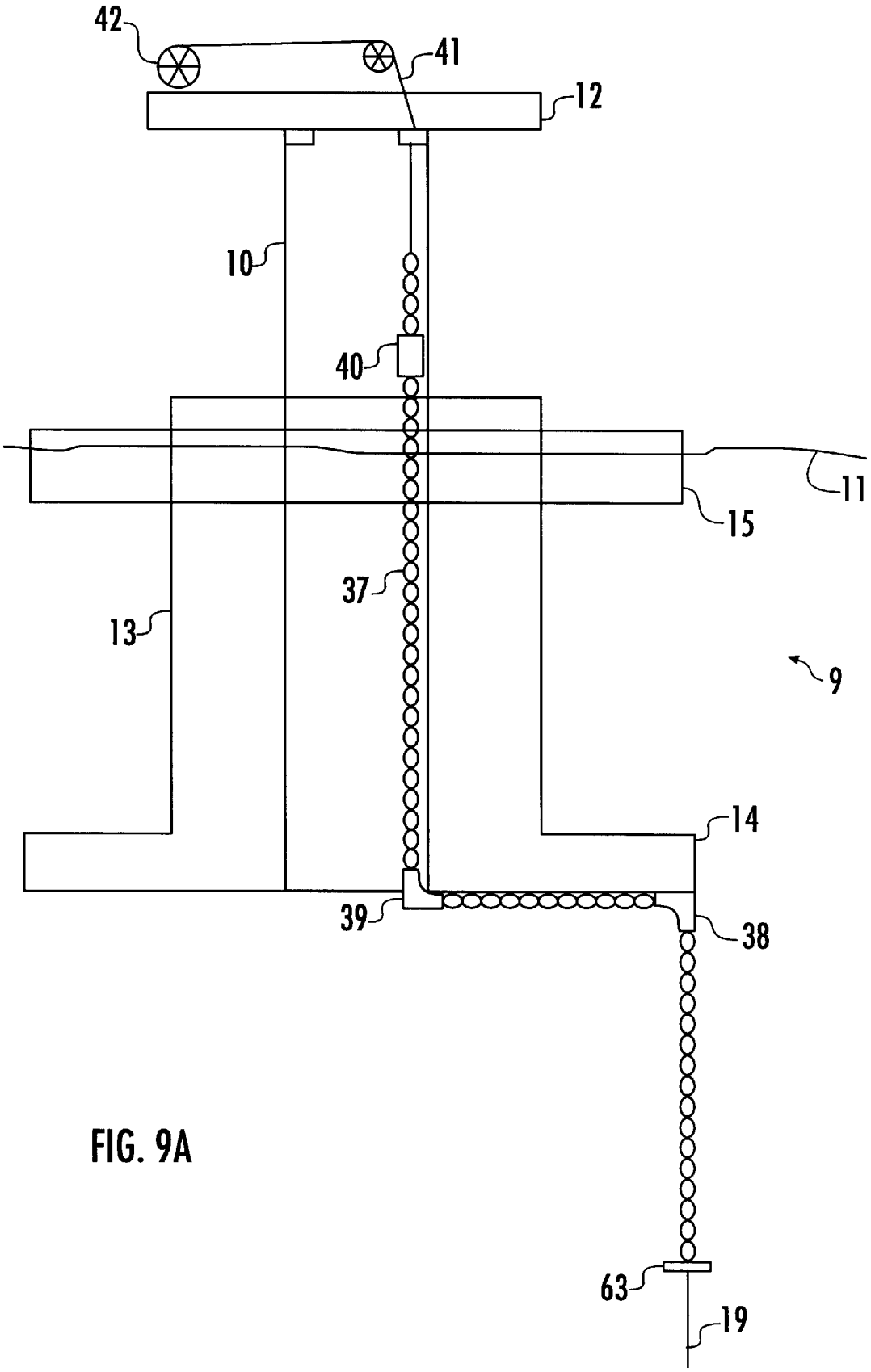
FIG. 9*a* is a plan view of the apparatus for attaching the tendon to the tension-leg platform.

Referring to FIG. 9*a*, an embodiment is shown for attachment of the tendon 19 to the tension-leg platform 9. The tendon 19 is attached to a chain 37 with a spinner 63 in between. The spinner 63 allows the tendon 19 to rotate relative to the chain 37. The chain 37 enters the tension leg platform 9 through one of the pontoons 14. The chain 37 is then directed through the pontoon 14 and up through the main buoyancy structure 13 of the tension-leg platform 9. A deflector 38 is located at the point where the chain enters pontoon 14 so as to deflect the direction of the chain. The chain enters the pontoon in a vertical direction and is deflected by a fairlead or deflector 38 toward the central axis of the buoyancy structure 13. Toward the 20 interior of the main buoyancy structure 13, the chain is again deflected by a second fairlead or deflector 39 which directs the chain vertically toward the monopod 10.

Figure 9B:
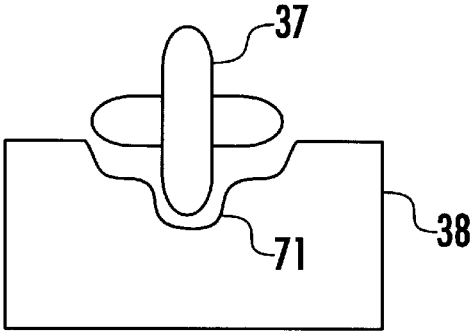
FIG. 9*b* is a side view of a sliding deflector.
Figure 9C:
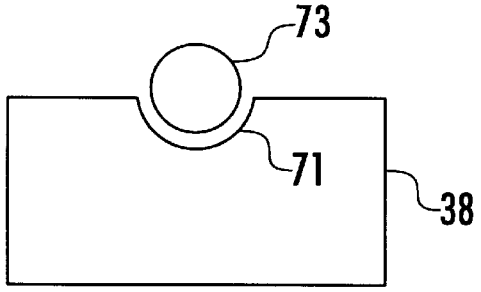
FIG. 9*c* is a side view of a sliding deflector.

These deflectors may comprise pulleys, sliding material, or any other device known. FIG. 9*b*, shows a side view of sliding deflector embodiment. The chain 37 slides within a groove 71 in the deflector 38 which conforms to the shape of the chain. Alternatively, as shown in FIG. 9*c*, a cable 73 may by deflected by the deflector 38 in which case the groove 71 conforms to the shape of the cable 73. MONOLOY material, produced by Smith-Berger of Vancouver, Wash., is a suitable sliding material.

Referring again to FIG. 9*a*, a wire 41 is attached to the free end of the chain 37. The wire 41 is engaged by a handling winch 42 which pulls the free end of the chain 37 vertically so that the chain 37 and the tendon 19 become tight. When a desired tension is obtained, the chain 37 is locked into place by a stopper 40 which is located in the monopod 10. A stopper 40 may comprise two protrusions which straddle a link of the chain so as to catch the next subsequent link in the chain. However, automatic stopping system, known in the art, may also be used. This stopper 40 may comprise a series of stoppers which engage the chain 37 at various positions. Multiple stoppers are used to provide redundancy should one of the stoppers fail. It should be understood that the stoppers may be located anywhere inside the tension leg platform 9, however, placement inside the monopod makes them easily accessible. Further, a similar chain configuration is used for each of the tendons 19 which are used to secure the tension leg platform 9 to the sea floor 23. The winch 42 and wire 41 are used to induce tension in each of the tendons 19, 27, etc., sequentially.

Figure 10A:
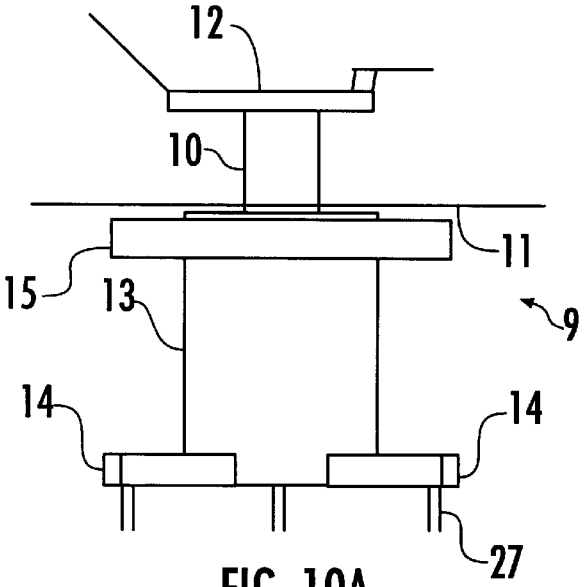
FIG. 10*a* is a plan view of the tension-leg platform in a presecured configuration.
Figure 10B:
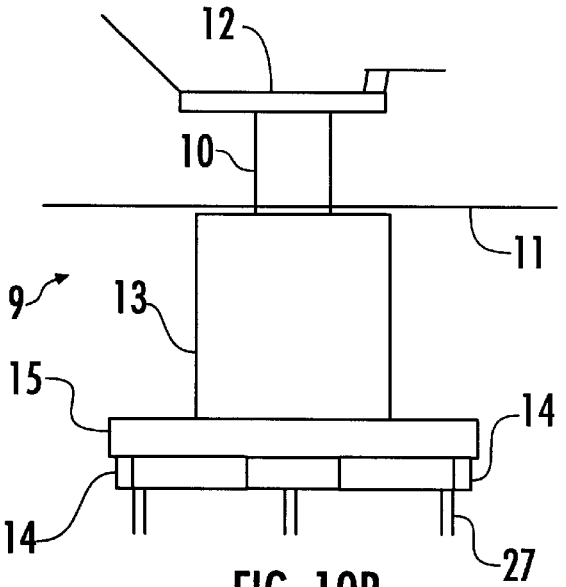
FIG. 10*b* is a plan view of the tension-leg platform in a postsecured configuration.

Referring to FIGS. 10*a* and 10*b*, embodiments of the present invention are shown. In FIG. 10*a*, configuration of the float 15 is such that it is affixed towards the upper end of main buoyancy structure 13. In this configuration, the float 15 provides stability to the tension leg platform 9 because of the increased water displacement at the surface of the water. Thus, in this configuration, the tension-leg platform 9 has increased stability which is important during the attachment of the tendons 27 to the sea floor 23 and to the tension-leg platform 9.

However, as soon as the tendons 27 are securely in place, the water displacement at the surface is no longer needed. In fact, once the tension-leg platform 9 is secured to the sea floor, increased surface area of the tension leg platform 9 at the surface of the water 11 is detrimental. As the waves act on the large surface area of the float 15 (see FIGS. 1*a*1 and 1*a*2), they induce resonance in the tension-leg platform 9 until the amplitude of the resonance is such that the tendons 27 begin to break. Therefore, as shown in FIG. 10*b*, once the tendon leg platform 9 has secured to the sea floor, the float 15 is moved by a mover so that it is lowered until it abuts against the pontoons 14. Example embodiments of the comprise mover of the float 15 comprise ballast, a pulley cable system, a hydraulic system, or any other system known. The float 15 is then attached to the pontoons 14 and to the main buoyancy structure 13 and the ballast is removed. Thus, the float 15 provides buoyancy to the tension leg platform 9 below the wave zone of the sea. In this configuration, the tension-leg platform 9 has a smaller cross section upon which the waves at the surface act. Additionally, with the float secured to the tension leg platform 9, the added buoyancy allows the tension leg platform to support several risers (not shown) which will be brought from the sea floor.

In this regard, the float 15 reduces the size of the TLP in the wave zone because once the float 15 is submerged to where it no longer pierces the surface of the sea, it does not displace seawater in the wave zone. The reducer of the size of the TLP in the wave zone may comprise a device which eliminates or reconfigures TLP structural elements so that less water is displaced in the wave zone. For example, in one embodiment, a crane used to remove members the reduce which support the TLP during transportation and assembly, but which are not required when the TLP is secured to the sea floor.

Figure 2:
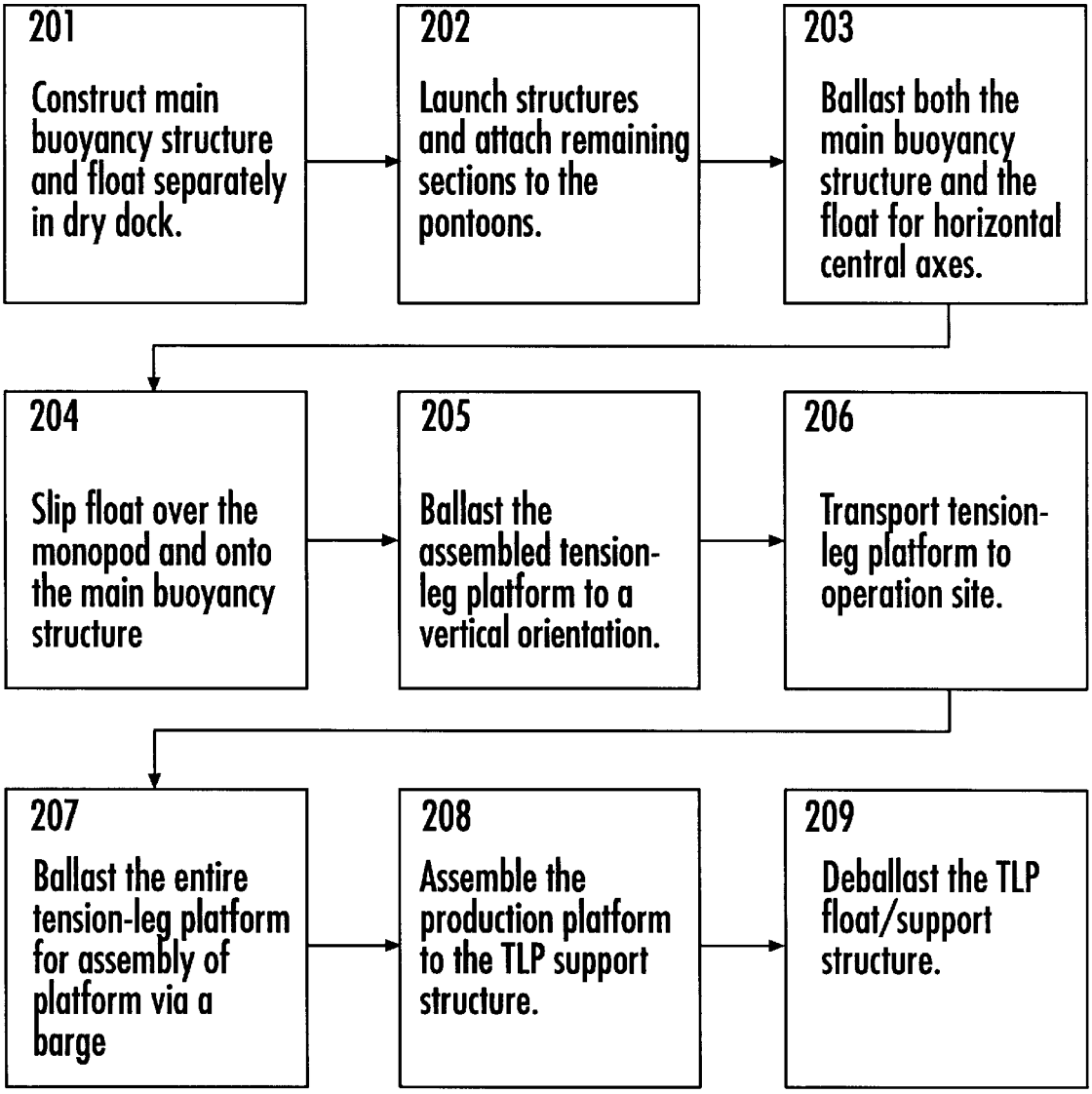
Figure 3A:
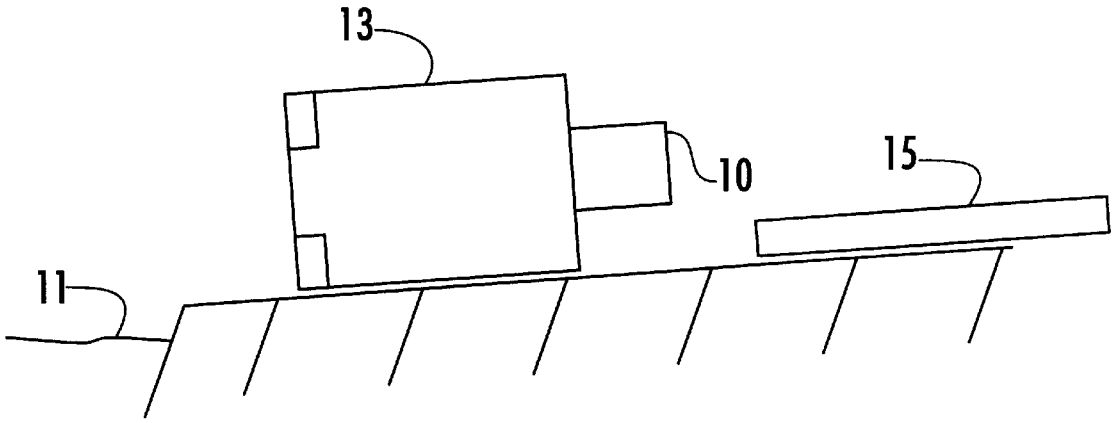
FIG. 3*a* is a plan view of the main buoyancy structure and float as constructed on land.
Figure 3B:
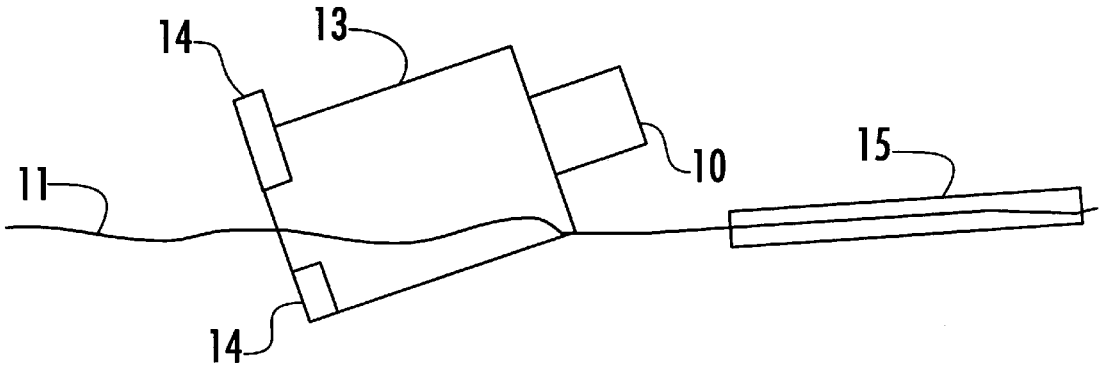
FIG. 3*b* is a plan view of the main buoyancy structure and float launched into the water.
Figure 3C:
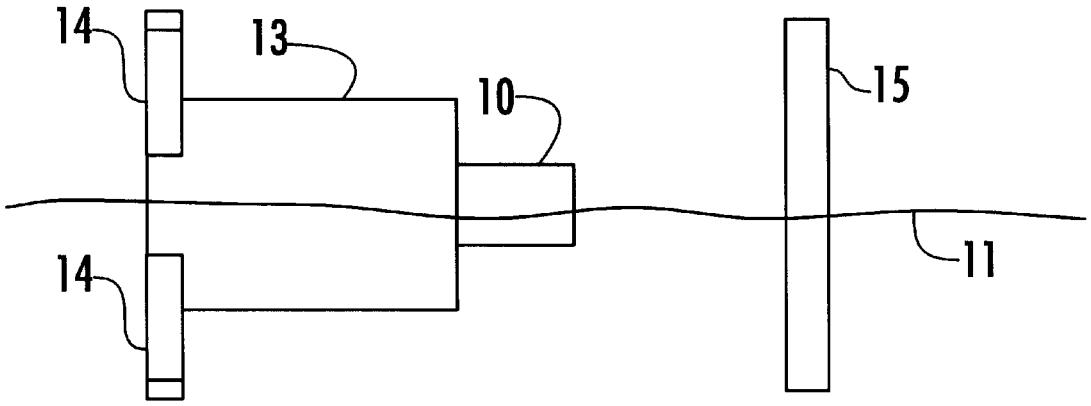
FIG. 3*c* is a plan view of the main buoyancy structure and float ballasted in horizontal orientations.
Figure 3D:
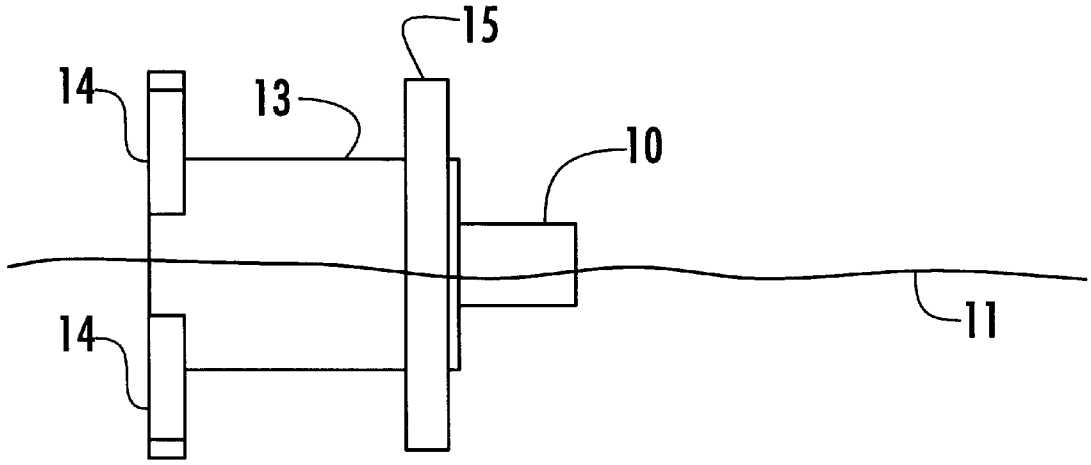
FIG. 3*d* is a plan view of the main buoyancy structure and float locked together.
Figure 3E:
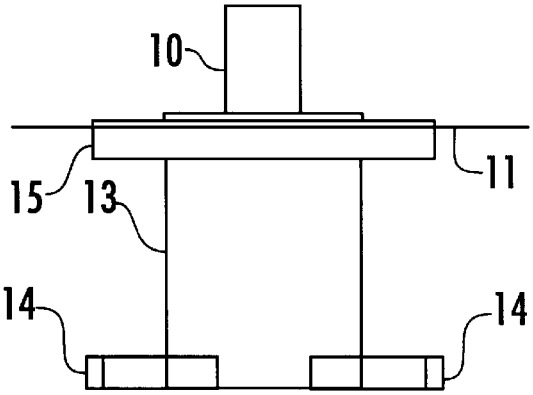
FIG. 3*e* is a plan view of the main buoyancy structure and float ballasted to a vertical orientation.
Figure 3F:
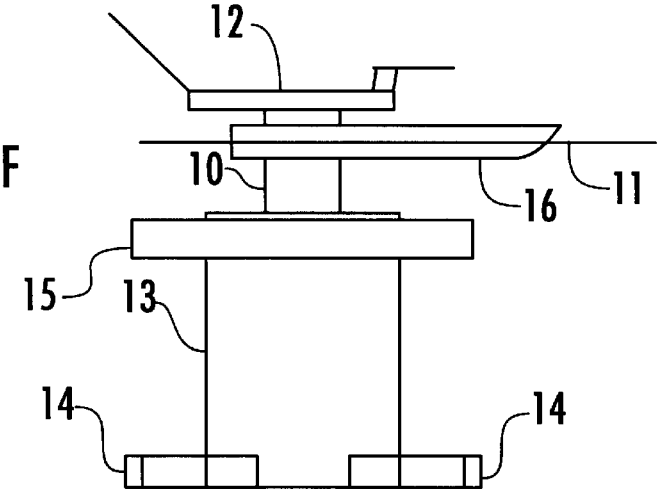
FIG. 3*f* is a plan view of the tension-leg platform and barge for assembling the platform.
Figure 3G:
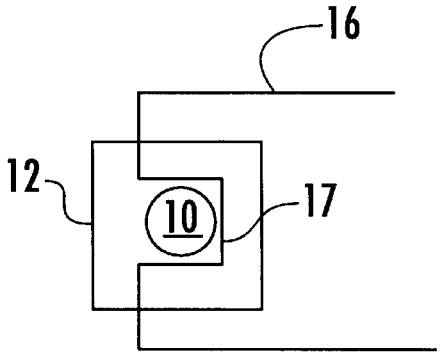
FIG. 3*g* is a top view of the tension-leg platform and barge for assembling the platform.
Figure 11C:
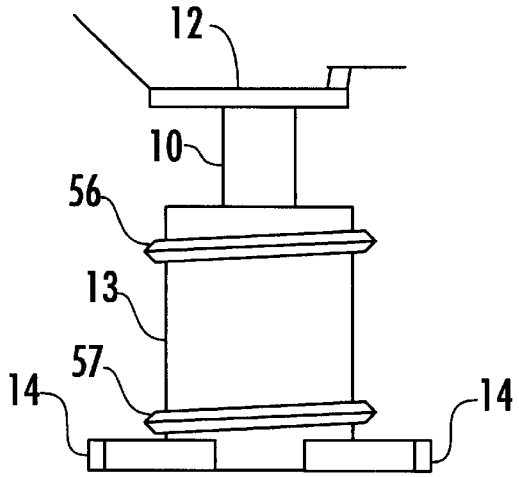
FIG. 11*c* is a plan view of an embodiment of an attacher of the generator to the TLP.
Figure 11C:
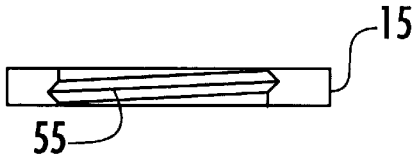
Figure 11C:
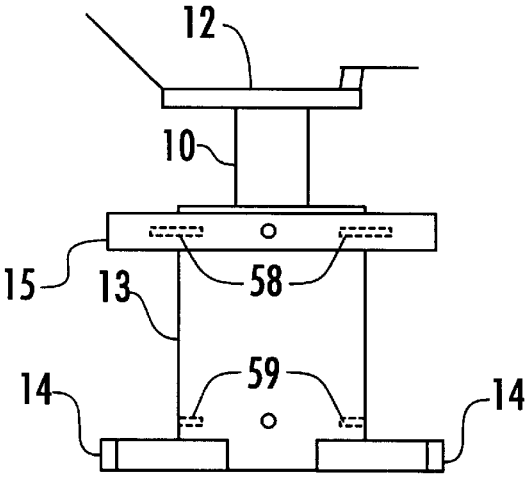
Figure 11C:
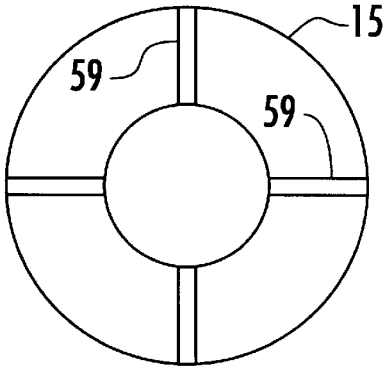
Figure 11C:
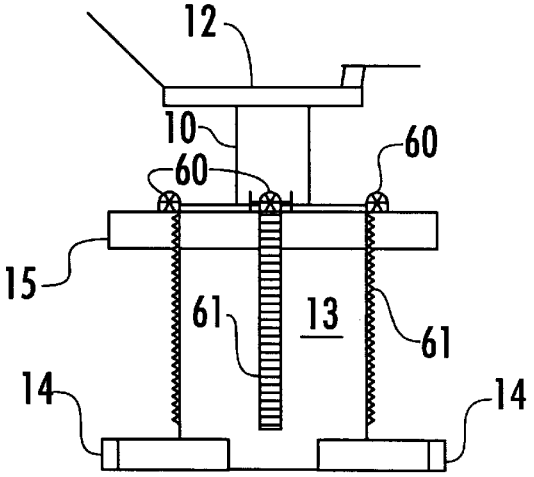

Referring to FIGS. 11*a*1 and 11*a*2, an attacher of the float to the TLP is shown. The generator of a stabilizing moment (float 15) comprises a generator thread 55 which allows float 15 to be twisted first onto the TLP thread 56 and second onto TLP thread 57. As shown in FIGS. 11*b*1 and 11*b*2, the attacher may comprise dowels 58 which extend between the TLP and the generator of a stabilizing moment (float 15) through dowel holes 59. In FIG. 11*c*, the attacher is shown to comprise generator teeth 60 and TLP teeth 61. The TLP teeth 61 are tracks of teeth which extend parallel to the TLP central axis on the outside of the main buoyancy structure 13. The generator teeth 60 are gears mounted on the generator of a stabilizing moment 15 for engagement with the TLP teeth 61.

It is to be noted that the above described embodiments illustrate only typical embodiments of the invention and are therefore not to be considered a limitation of the scope of the invention which includes other equally effective embodiments.

I claim:

1. A process for stabilizing a tension-leg platform (TLP), wherein the TLP comprises a central axis, the process comprising:

generating a stabilizing moment with a member of the TLP, wherein said generating vertically aligns the central axis of the TLP;

securing the TLP to the sea floor after said generating a stabilizing moment; and reducing the size of the TLP in the wave zone, after the platform is secured to the sea floor.

2. A process as in claim 1, wherein said generating comprises displacing seawater at a location distant from the central axis.

3. A process as in claim 2, wherein said displacing comprises attaching a float to the TLP.

4. A process as in claim 1, wherein said reducing comprises removing structural elements of the TLP from the wave zone.

5. A process as in claim 1, wherein said reducing comprises removing a float from the wave zone.

6. A process as in claim 1, wherein said reducing comprises moving a float from a position in the wave zone to a position below the wave zone.

7. A device for stabilizing a tension-leg platform (TLP) which is secured and tensioned to the sea floor and comprises a central axis, the device comprising:

a generator for generating a stabilizing moment, before the platform is secured and tensioned to the sea floor, wherein said generator vertically aligns the central axis of the TLP; and a reducer for reducing the size of the TLP in the wave zone after a tendon of the platform is secured to the sea floor.

8. A device as in claim 7, wherein said generator comprises a displacer of seawater at a location distant from the central axis of the TLP.

9. A device as in claim 8, wherein said displacer comprises a float.

10. A device as in claim 8, wherein said displacer comprises a plurality of displacers which encircle a plurality of supports which connect a deck and a subsea structure of the TLP, wherein at least one of said plurality of displacers encircles at least one of said plurality of supports.

11. A device as in claim 7, wherein said generator encircles the central axis of the TLP.

12. A device as in claim 7, wherein said generator encircles a plurality of vertical supports of the TLP.

13. A device as in claim 1, wherein said reducer comprises a remover of said generator from the wave zone.

14. A device as in claim 7, further comprising an attacher of the generator to the platform for attachment at a wave zone position and a lower position relative to the platform nonsimultaneously.

15. A device as in claim 14, wherein said attacher comprises a generator thread and a TLP thread, wherein said generator thread mates with said TLP thread when said generator thread is rotated relative to said TLP thread.

16. A device as in claim 14, wherein said attacher comprises generator teeth and TLP teeth, wherein said generator teeth mate with said TLP teeth.

17. A device as in claim 14, wherein said attacher comprises at least one dowel which extends between said generator and the TLP.

18. A device as in claim 14, wherein said attacher comprises cords which extend from said generator to the TLP.

19. A tension-leg platform (TLP) for deep sea mineral production comprising a central axis and designed for attachment to the water bottom by a tendon, the TLP comprising:

a buoyancy structure for floating the TLP at the sea surface;

a platform for mineral production operations located above the sea surface;

a support which connects at a lower end to said buoyancy structure and connects at an upper end to said platform;

a stabilizing moment generator substantially completely encircling the central axis of the TLP and arranged for vertical alignment of the central axis of the TLP, and a means for reducing the size of the TLP in the wave zone.

20. A TLP as in claim 19, wherein said generator comprises a float positioned at a location distant from a vertical central axis of the TLP.

21. A TLP as in claim 19, wherein said generator comprises a plurality of floats and said support comprises a plurality of supports, wherein at least one of said plurality of floats encircles at least one of said plurality of supports.

22. A TLP as in claim 19, wherein said means for reducing comprises a remover of structural elements of the TLP from the wave zone.

23. A TLP as in claim 19, further comprising an attacher of the generator to the platform.

24. A TLP as in claim 23, wherein said attacher comprises a generator thread and a TLP thread, wherein said generator thread mates with said TLP thread when said generator thread is rotated relative to said TLP thread.

25. A TLP as in claim 23, wherein said attacher comprises generator teeth and TLP teeth, wherein said generator teeth mate with said TLP teeth.

26. A TLP as in claim 23, wherein said attacher comprises at least one dowel which extends between said generator and the TLP.

27. A TLP as in claim 23, wherein said attacher comprises cords which extend from said generator to the TLP.

28. A process for assembling a tension-leg platform (TLP) comprising a float, buoyancy-support and platform, the process comprising:

stabilizing the buoyancy-support with the float;

ballasting the buoyancy-support until the buoyancy-support resides lower in the sea relative to the sea surface; and assembling the platform to the buoyancy-support.

29. A process as in claim 28, further comprising deballasting the assembled tension-leg platform.

30. A device for stabilizing a tension-leg platform (TLP) which is secured and tensioned to the sea floor and comprises a central axis, the device comprising:

a generator for generating a stabilizing moment, before the platform is secured and tensioned to the sea floor, wherein said generator vertically aligns the central axis of the TLP;

a reducer for reducing the size of the TLP in the wave zone after a tendon of the platform is secured to the sea floor; and an attacher of the generator to the platform for attachment at a wave zone position and at a lower position relative to the platform nonsimultaneously, said attacher comprising a generator thread and a TLP thread, wherein said generator thread mates with said TLP thread when said generator thread is rotated relative to said TLP thread.

31. A device for stabilizing a tension-leg platform (TLP) which is secured and tensioned to the sea floor and comprises a central axis, the device comprising:

a generator for generating a stabilizing moment, before the platform is secured and tensioned to the sea floor, wherein said generator vertically aligns the central axis of the TLP;

a reducer for reducing the size of the TLP in the wave zone after a tendon of the platform is secured to the sea floor; and an attacher of the generator to the platform for attachment at a wave zone position and at a lower position relative to the platform nonsimultaneously, wherein said attacher comprises generator teeth and TLP teeth, wherein said generator teeth mate with said TLP teeth.

32. A device for stabilizing a tension-leg platform (TLP) which is secured and tensioned to the sea floor and comprises a central axis, the device comprising:

a generator for generating a stabilizing moment, before the platform is secured and tensioned to the sea floor, wherein said generator vertically aligns the central axis of the TLP;

a reducer for reducing the size of the TLP in the wave zone after a tendon of the platform is secured to the sea floor; and an attacher of the generator to the platform for attachment at a wave zone position and at a lower position relative to the platform nonsimultaneously, wherein said attacher comprises at least one dowel which extends between said generator and the TLP.

33. A tension-leg platform (TLP) for deep sea mineral production comprising a central axis and designed for attachment to the water bottom by a tendon, the TLP comprising:

a buoyancy structure for floating the TLP at the sea surface;

a platform for mineral production operations located above the sea surface;

a support which connects at a lower end to said buoyancy structure and connects at an upper end to said platform;

a stabilizing moment generator positioned and arranged for vertical alignment of the central axis of the TLP;

a means for reducing the size of the TLP in the wave zone; and an attacher of the generator to the platform, wherein said attacher comprises a generator thread and a TLP thread, wherein said generator thread mates with said TLP thread when said generator thread is rotated relative to said TLP thread.

34. A tension-leg platform (TLP) for deep sea mineral production comprising a central axis and designed for attachment to the water bottom by a tendon, the TLP comprising:

a buoyancy structure for floating the TLP at the sea surface;

a platform for mineral production operations located above the sea surface;

a support which connects at a lower end to said buoyancy structure and connects at an upper end to said platform;

a stabilizing moment generator positioned and arranged for vertical alignment of the central axis of the TLP;

a means for reducing the size of the TLP in the wave zone; and an attacher of the generator to the platform, wherein said attacher comprises generator teeth and TLP teeth, wherein said generator teeth mate with said TLP teeth.

35. A tension-leg platform (TLP) for deep sea mineral production comprising a central axis and designed for attachment to the water bottom by a tendon, the TLP comprising:

a buoyancy structure for floating the TLP at the sea surface;

a platform for mineral production operations located above the sea surface;

a support which connects at a lower end to said buoyancy structure and connects at an upper end to said platform;

a stabilizing moment generator positioned and arranged for vertical alignment of the central axis of the TLP;

a means for reducing the size of the TLP in the wave zone; and an attacher of the generator to the platform, wherein said attacher comprises at least one dowel which extends between said generator and the TLP.

* * * * *

UNITED STATES PATENT AND TRADEMARK OFFICE

CERTIFICATE OF CORRECTION

PATENT NO : 5,997,218

DATED : December 7, 1999

INVENTOR(S) : Knut Børseth

It is certified that error appears in the above-identified patent and that said Letters Patent is hereby corrected as shown below:

In Column 1, Line 47, the word "Hove," should read -- However --.

In Column 3, Lines 31-32, "and a top view of the generator alone." should read -- and the generator --.

In Column 3, Lines 61-62, "The float 15 comprises a generator of a stabilizing moment" should read -- The float 15 generates a stabilizing moment --.

In Column 5, Line 24, "ROV 20 and auxiliary wire" should read -- ROV and auxiliary wire --.

In Column 6, Line 38, "Toward the 20 interior of"' should read -- Toward the interior of --.

In Column 7, Lines 25-26, "Example embodiments of the comprise mover of" should read -- Example embodiments of the mover of --.

In Column 7, Line 45, "a crane used to remove members the reduce" should read -- a crane (the mover) is used to remove members (the reducer) --.

In Column 8, Claim 13, "claim 1," should read -- claim 7 --.

Signed and Sealed this

Tenth Day of October, 2000

*Attest:*

*Attesting Officer*

Q. TODD DICKINSON

*Director of Patents and Trademarks*